US008637133B2

(12) United States Patent
Vagliardo

(10) Patent No.: US 8,637,133 B2
(45) Date of Patent: Jan. 28, 2014

(54) PLACEMAT HAVING AN INTEGRATED NAPKIN RING AND METHOD OF MAKING AND USING THE SAME

(75) Inventor: Courtney J. Vagliardo, Brooklyn, NY (US)

(73) Assignee: Ex-Cell Home Fashions, Inc., New York, NY (US)

( * ) Notice: Subject to any disclaimer, the term of this patent is extended or adjusted under 35 U.S.C. 154(b) by 194 days.

(21) Appl. No.: 13/165,945

(22) Filed: Jun. 22, 2011

(65) Prior Publication Data

US 2012/0328827 A1 Dec. 27, 2012

(51) Int. Cl.
*A47G 21/16* (2006.01)
*A47G 23/00* (2006.01)

(52) U.S. Cl.
USPC ..... 428/99; 428/136

(58) Field of Classification Search
USPC ..... 428/99, 136; 24/7, 9; 206/562, 565
See application file for complete search history.

(56) References Cited

U.S. PATENT DOCUMENTS 3,376,974 A * 4/1968 Hilliard ..... 206/217

OTHER PUBLICATIONS

Napkin catch by Josh Jakus—recycled rubber placemats [online] [retrieved May 17, 2011]. Retrieved from the Internet <URL: http://actualsf.com/napkin-catch.php>. 1 page.

Untitled placemat, [online] [retrieved May 17, 2011]. Retrieved from the Internet <URL: http://www.greatgreengoods.com/wp-content/uploads/2008/061josh_placement_orange.jpg>. 1 page.

Untitled placement, [online] [retrieved May 17, 2011]. Retrieved from the Internet <URL: http://1.bp.blogspot.com/_r30JOKTfYjE/Sf820qQ5q_I/AAAAAAAAAYw/Koi-SCKG8KM/s400/17016_dp_e(700x600).jpg (accessed May 17, 2011) 1 page.

Orange and sugar: May 2009 [online] [retrieved May 17, 2011]. Retrieved from the Internet <URL: http://orangeandsugar.blogspot.com/2009_05_01_archive.html>. 11 pages.

Placement with Built-in Napkin Holder—Recycled Rubber | Great Green Goods—Shopping the Eco-frien . . . [online] [retrieved Sep. 23, 2011]. Retrieved from the Internet <URL: http://www.greatgreengoods.com/2008/06/10/placemat-with-built-in-napkin-holder-recycled-rubber/>. 8 pages.

* cited by examiner

*Primary Examiner* — Alexander Thomas
(74) *Attorney, Agent, or Firm* — Alston & Bird LLP

(57) ABSTRACT

A placemat assembly having an integrated napkin ring and a method of making and using the placemat assembly are provided. The method may include forming at least two openings in a placemat such that a midpoint of the distance between the two openings is located in a position offset from the center of the placemat. The method may further include attaching a napkin ring to the placemat and fastening the napkin ring so as to secure a napkin to the placemat assembly. In various embodiments, the opening may be a variety of shapes and sizes and may have a periphery that is sewn. The placemat, napkin ring, and napkin may be a variety of shapes, sizes, colors, and materials.

14 Claims, 8 Drawing Sheets

PLACEMAT HAVING AN INTEGRATED NAPKIN RING AND METHOD OF MAKING AND USING THE SAME

FIELD OF THE INVENTION

The present invention relates to placemats and napkin rings, and more specifically to a placemat having an integrated napkin ring and a method of making and using the same.

BACKGROUND

Traditionally, placemats, napkins and napkin rings have been separately manufactured and distributed, only to be used in conjunction with one another after purchase by consumers. This model of having independent items provides flexibility for consumers, permitting personalized purchases and interchangeability of placemats, napkins and the napkin rings. Even so, consumers are often frustrated when they cannot subsequently replace a broken, lost or damaged napkin ring, napkin or placemat, such as when manufacturers have discontinued a certain napkin ring, napkin or placemat. Additionally, in recent years as consumers are becoming more aware of the environmental impact of the products they buy, many consumers prefer more simplistic and livable items.

Therefore, it would be beneficial to provide a placemat assembly solution that is economical, simplistic, and livable while preferably not entirely sacrificing consumer flexibility or the aesthetic or useful characteristics of a placemat setting.

BRIEF SUMMARY

One or more embodiments of a placemat having an integrated napkin ring and a method of making and using the placemat assembly are disclosed herein that address one or more of the above issues. According to embodiments of the present invention, a placemat assembly is provided that includes a napkin ring, and a placemat having at least two openings disposed therein through which the napkin ring passes. In one embodiment, the placemat may be substantially rectangular in shape. Further, the placemat may include a peripheral border comprising a decorative pattern.

The openings of the placemat assembly may further include a periphery that is sewn. In addition, each of the openings may be substantially a slit configured to receive at least a portion of the napkin ring therethrough. Further, in one embodiment, a midpoint of the distance between the two openings may be disposed at a position offset from the center of the placemat. In another embodiment, the center of each of the at least two openings may be located on a linear axis bisecting the placemat. According to one embodiment, the length of each of the openings may be approximately two inches and a distance between the two openings may be about two and a half inches.

According to one embodiment, the napkin ring may be shaped substantially as a rectangular strip of fabric and may include a fastener. In certain embodiments, the fastener may include a button and a buttonhole adapted to receive the button therethrough. In addition, the fastener may be configured to join a proximal end of a napkin ring to a distal end of the napkin ring. According to one embodiment, the napkin ring may include a decorative pattern, such as a checkered pattern, a plaid pattern, a stripped pattern or the like, substantially similar to a decorative border of the placemat. According to another embodiment, a napkin is provided that is substantially square. Further, the napkin ring may be configured to secure the napkin to the placemat assembly when a fastener of the napkin ring is engaged.

Other embodiments of the present invention provide methods of making or manufacturing a placemat having an integrated napkin ring. For example, according to an embodiment, a method includes forming at least two openings in a placemat having a center and a perimeter such that a midpoint of the distance between the two openings is located in a position offset from the center of the placemat. The step of forming an opening may further involve sewing the peripheral edge of the at least two openings.

These and other features and advantages of the present invention will become apparent to one skilled in the art upon examination of the following drawings and detailed description. It is intended that all such features and advantages be included herein within the scope of the present invention.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION

Various embodiments of the present invention now will be described more fully hereinafter with reference to the accompanying drawings, in which some, but not all embodiments of the inventions are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Placemat

Figure 1:
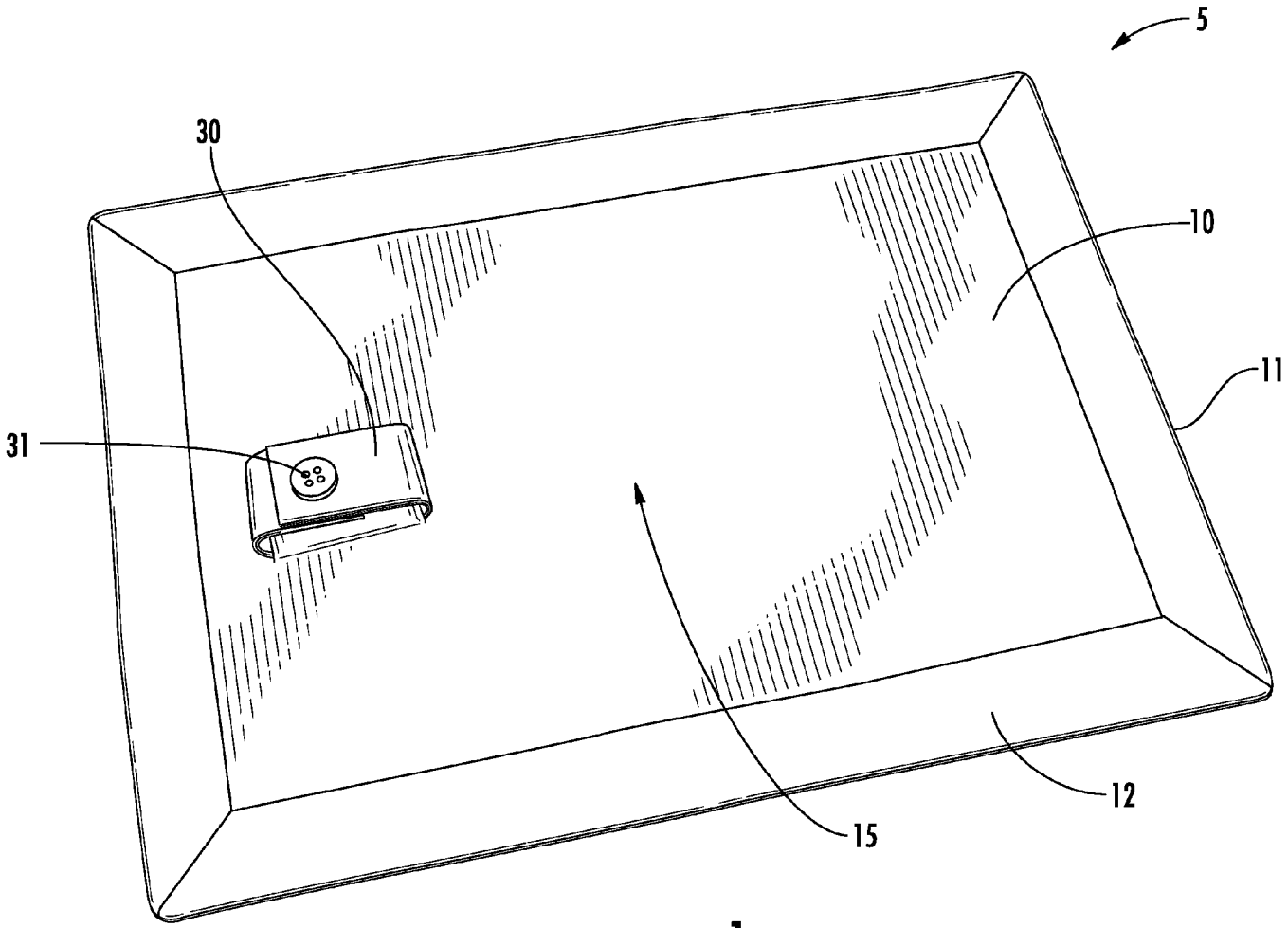
FIG. 1 is a top perspective view of a placemat assembly consistent according to one embodiment.
Figure 2:
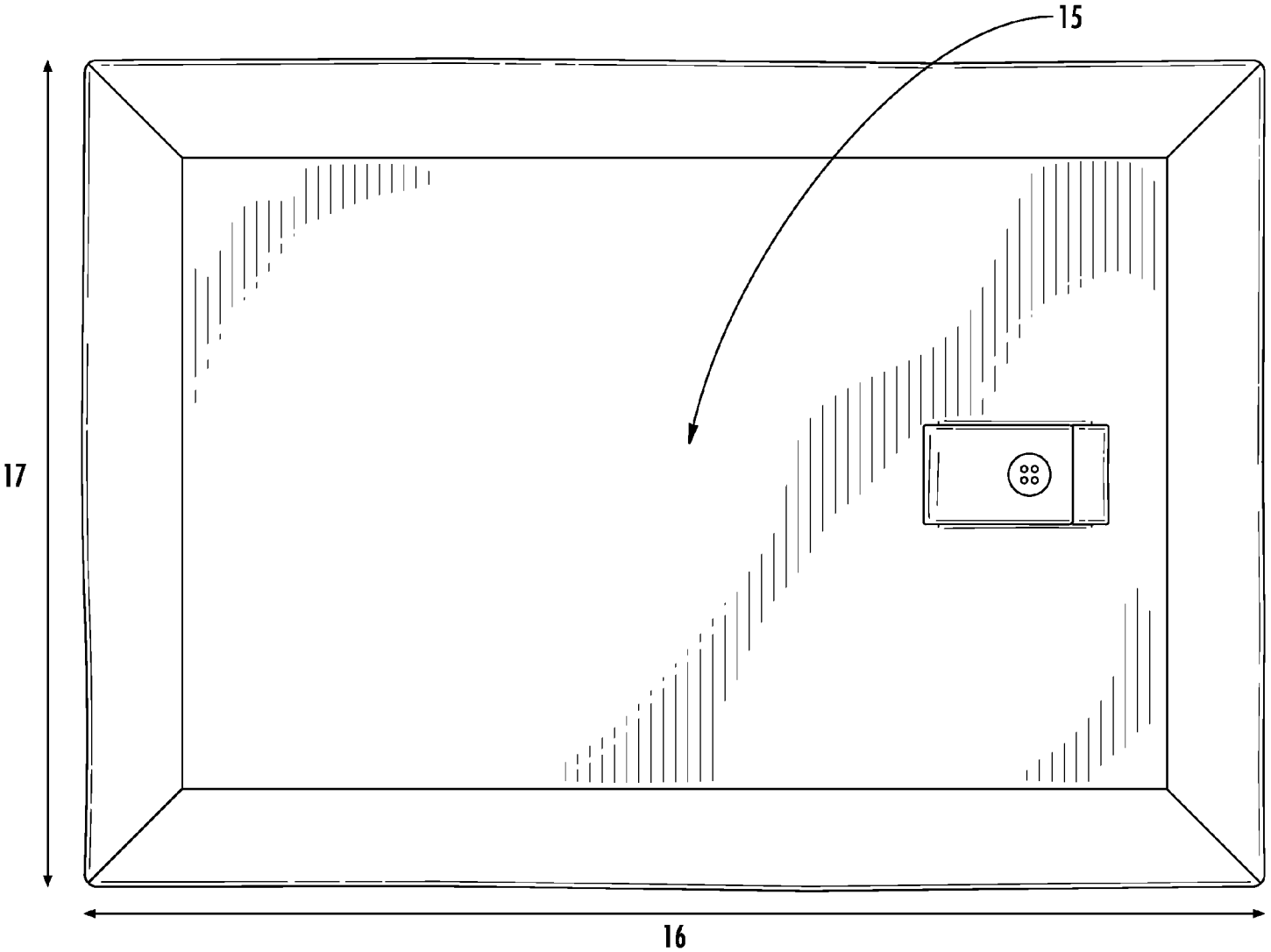
FIG. 2 is a top view of a placemat assembly according to one embodiment.
Figure 3:
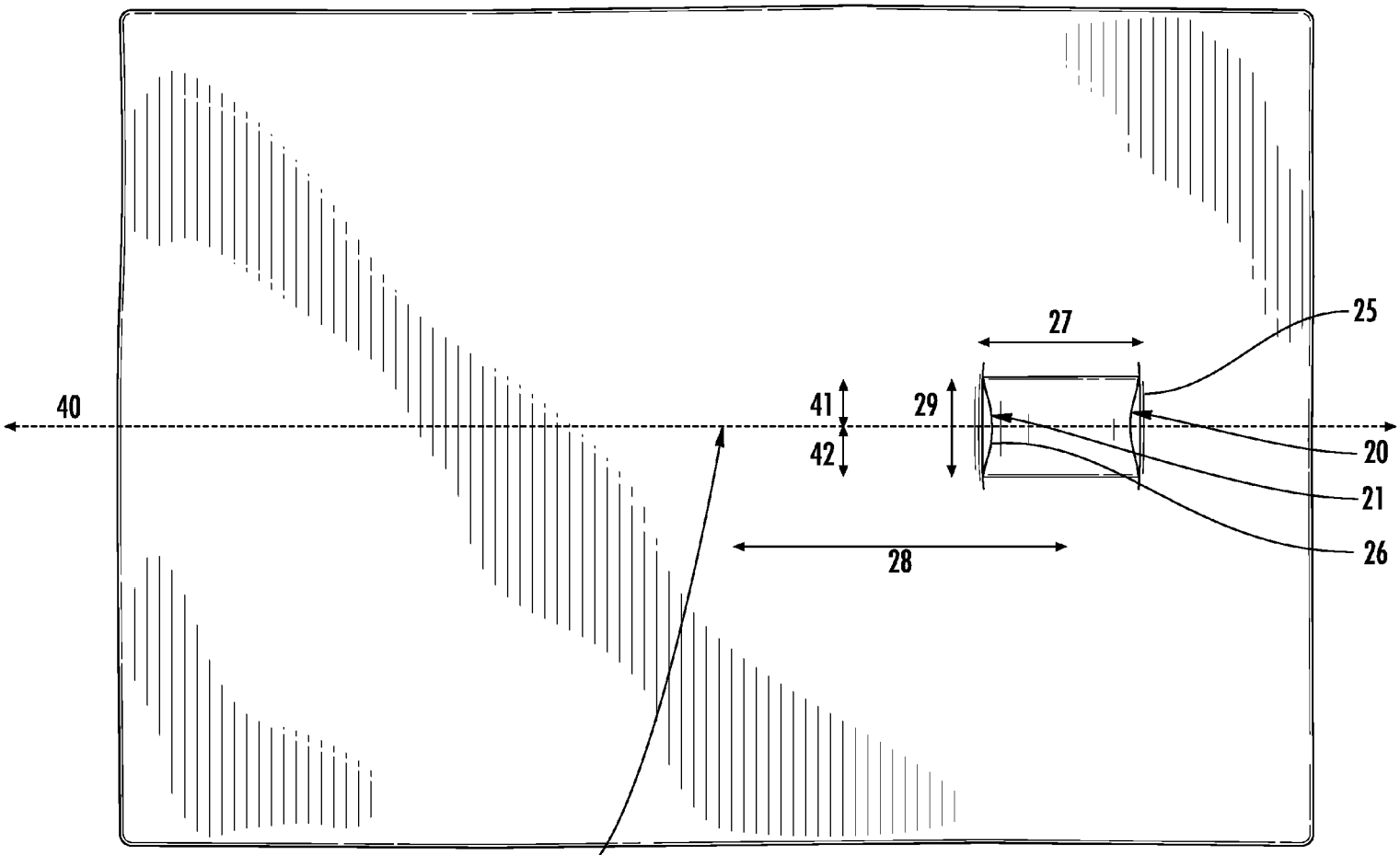
FIG. 3 is a bottom view of a placemat assembly according to one embodiment.
Figure 4:
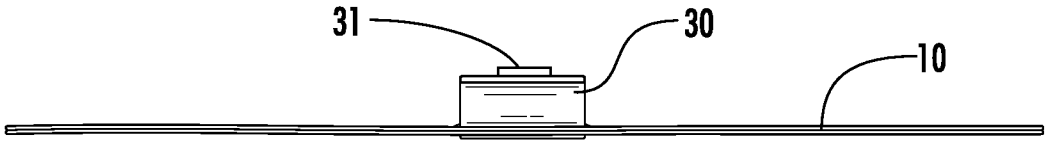
FIG. 4 is a side view of a placemat assembly according to one embodiment.
Figure 5:
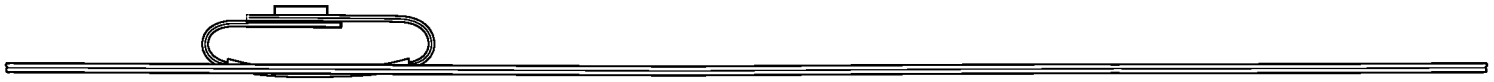
FIG. 5 is a front view of a placemat assembly according to one embodiment.
Figure 6:
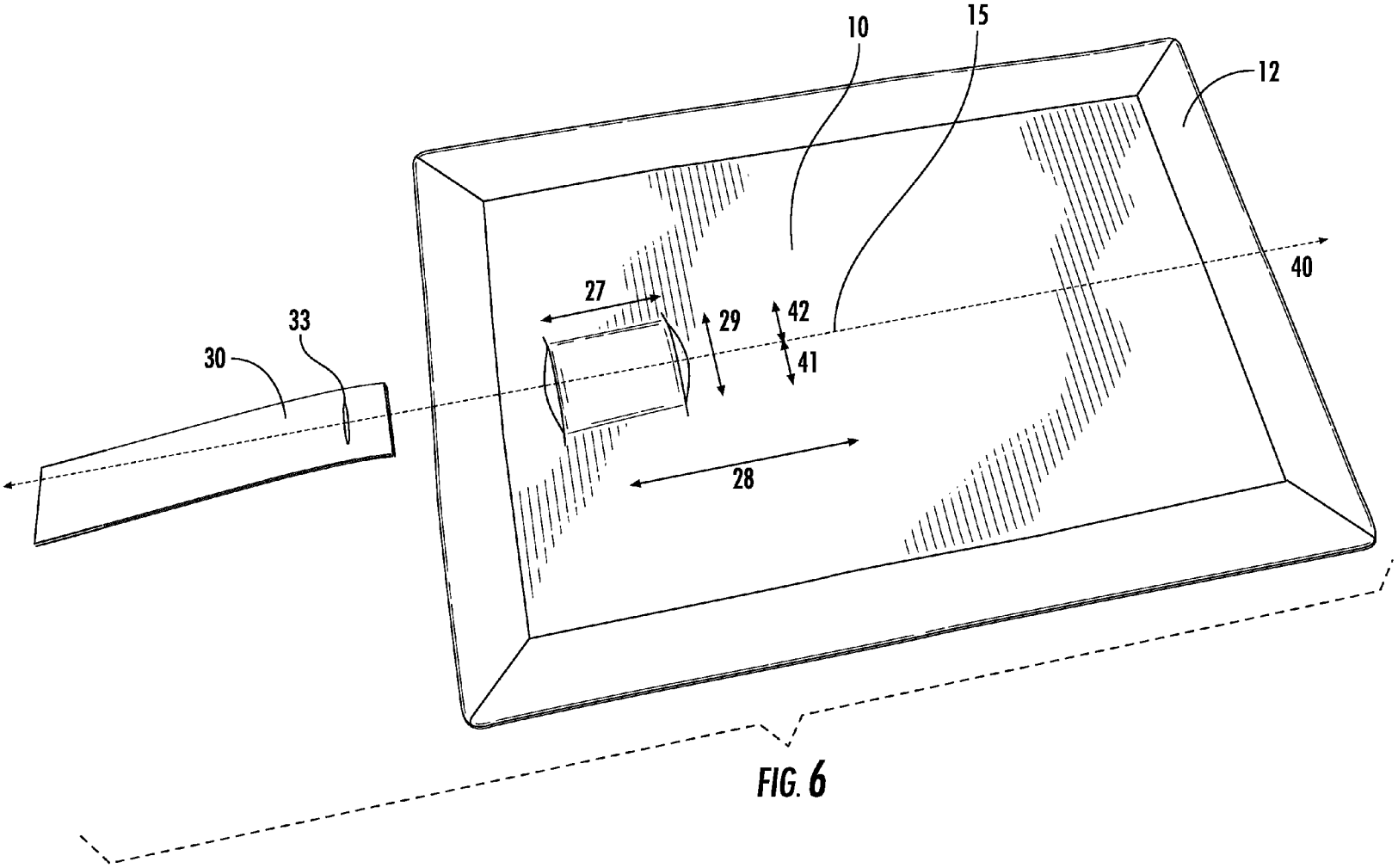
FIG. 6 is a partially exploded view of a placemat assembly according to one embodiment.
Figure 7:
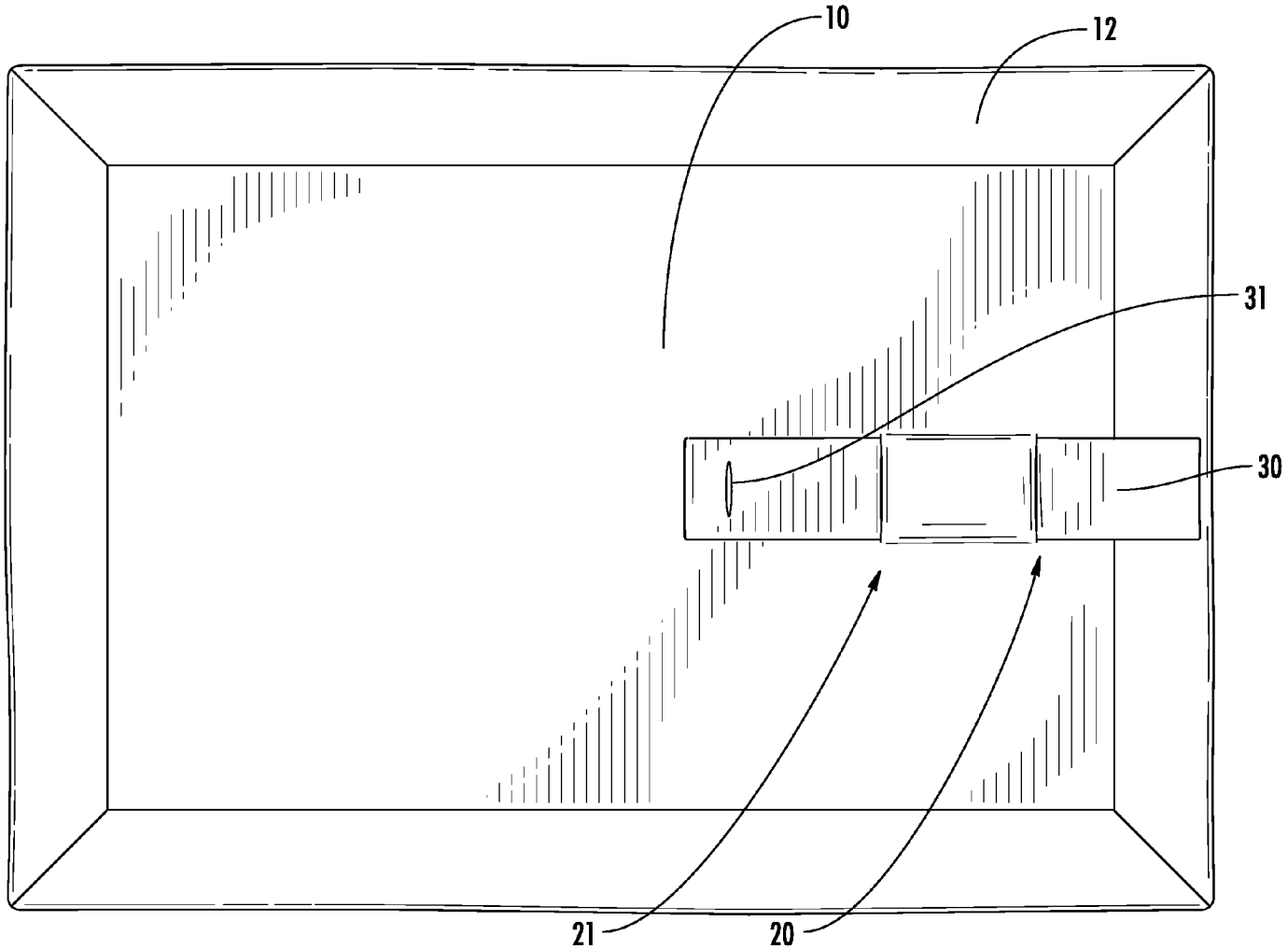
FIG. 7 is a top view of a placemat assembly, wherein a fastener of a napkin ring is not engaged according to one embodiment.

FIG. 1 illustrates a placemat assembly 5 according to various embodiments of the present invention. The placemat assembly 5 includes a placemat 10, which includes a perimeter 11. In certain embodiments, the placemat 10 is substantially rectangular and the perimeter 11 comprises four sides that form the edges of the placemat 10. According to those embodiments having a substantially rectangular placemat 10, the perimeter 11 comprises four sides, with a first set of two opposing sides having a length 16 and a second set of two opposing sides having a height 17. In certain embodiments having a rectangular placemat 10, the length 16 and the height 17 are not substantially the same. In one embodiment, the placemat 10 may have a length 16 of approximately nineteen and a quarter inches (19.25") and a height 17 of about thirteen and seven-eighths inches (13⅞"). In other embodiments, the length 16 and height 17 of the two sets of four sides may be any dimension, including those known and used in the art of placemats.

In another embodiment, the placemat may be substantially square. According to those embodiments having a square placemat 10, the length 16 and height 17 of the placemat are substantially the same. Further still, in other embodiments, the placemat 10 may be substantially circular, oval, or any of a variety of other geometric or non-uniform desired shapes, including those known and used in the art of placemats.

In various embodiments, the placemat may be constructed of a fabric material. The fabric material may include, but is not limited to, linen, cotton, polyester, rayon, nylon, acrylic, acetate, or any combination of the same. In other embodiments, the placemat may be constructed of one or more of a variety of fabric and/or non-fabric materials, such as flexible materials including but not limited to, vinyl and paper, as known and understood in the art of placemats. According to another embodiment, the placemat may be constructed of one or more of a variety of materials, such as cork, plastics, wood, grass cloth, plant materials and/or the like. In another embodiment, the placemat may be constructed using one or more techniques such as weaving, bonding, latticing, extruding, molding and/or the like.

Openings

In various embodiments, the placemat 10 further includes at least one opening 20. In certain embodiments, the placemat 10 includes two openings 20, 21 that each includes a peripheral edge 25, 26. In certain embodiments, the opening is substantially a slit. In other embodiments, the opening may be substantially square, circular, elongated, oval or similarly shaped, or another opening shape. According to one embodiment, the openings may be built into a weave, lattice, or other voids in a placemat. In another embodiment, the openings may be built into the placemat by removing placemat material at a desired opening location.

Figure 8:
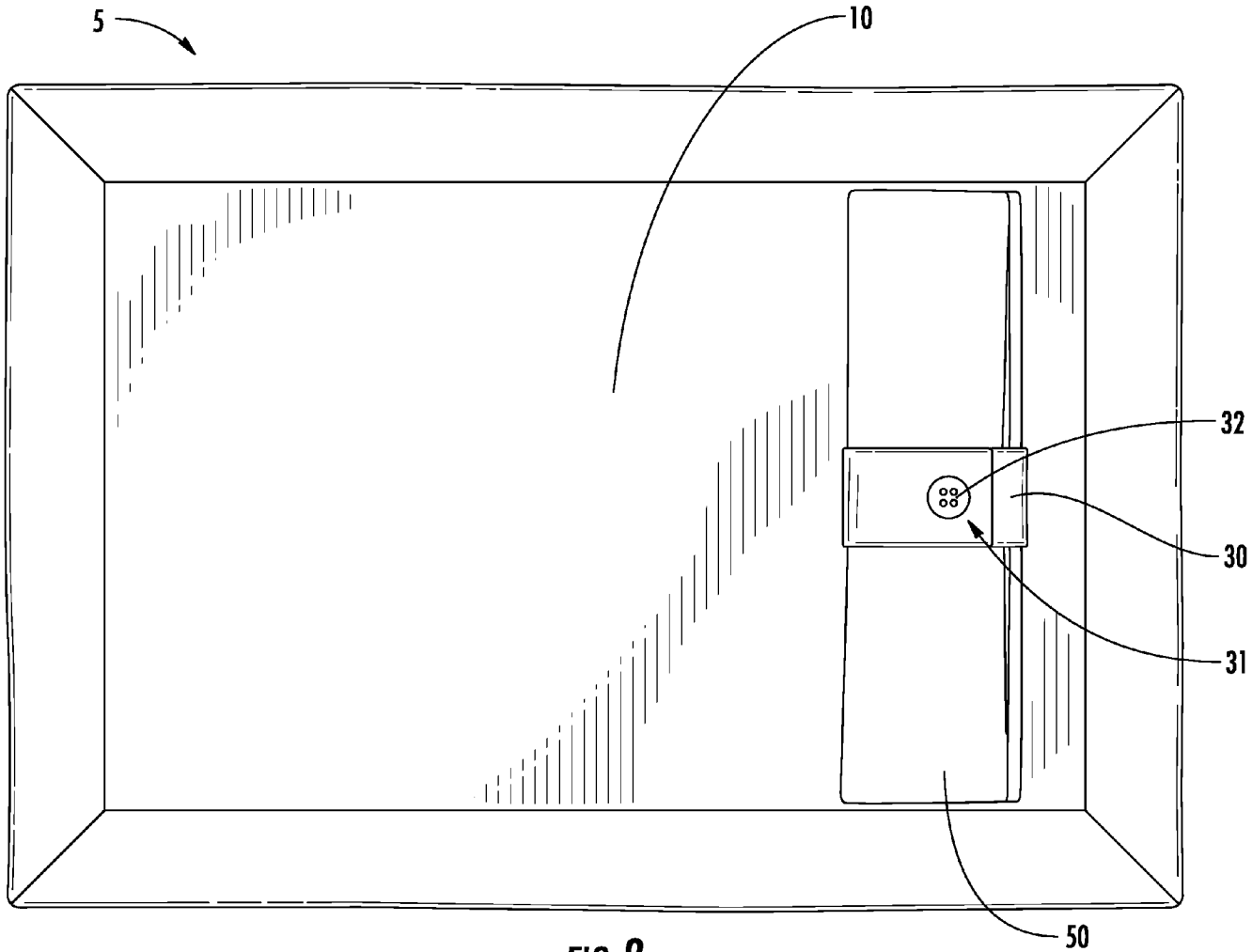
FIG. 8 is a top view of a placemat assembly according to another embodiment.

As shown in FIG. 8, the placemat 10 includes two openings 20, 21 that each includes a peripheral edge 25, 26 that is sewn, such as stitched with a repeating pattern and/or the like. The sewn peripheral edges 25, 26 provide reinforcement for the placemat openings such that repeated passing of the napkin ring 30 through the openings will not substantially deteriorate the structural integrity of the openings 20, 21. In other embodiments, a peripheral edge may include other reinforcement means, such as a bonding or welding of other reinforcing materials. In another embodiment, the shape of a peripheral edge may be straight, curved, or patterned, such as in a tooth, wave, gear configuration and/or the like. In addition, another embodiment may include peripheral edges that may include decorative edges that surround the openings. In one embodiment, the peripheral edges may include a metal grommet. In another embodiment, the peripheral edges may include a sealing or coating of material for reinforcing the peripheral edges.

The openings 20, 21 are sized to receive at least a portion of the napkin ring 30 therethrough. In certain embodiments where the openings include a slit opening, each of the openings 20, 21 may have a length 29 of about two inches (2"). According to another embodiment, the length of a slit opening may correspond to a width of a napkin ring so as to accept the napkin ring passing therethrough. In other embodiments, the lengths of the openings may be approximately one to three inches (1-3"). In various other embodiments, the size of the openings may be any size as known or understood in the art as being sufficient to permit at least a portion of the napkin ring 30 to be received therethrough.

Further, in some embodiments, the openings 20, 21 are spaced apart from each other by a distance 27 of approximately two and a half inches (2.5"). In other embodiments, the openings may be spaced apart by a distance of approximately two to three inches (2-3"). Further still, the distance between the openings 20, 21 may be any size understood in the art as being sufficient to permit at least a portion of the napkin ring 30 to be received through each of the openings 20, 21.

In various embodiments, the openings 20, 21 are offset from the center 15 of the placemat 10. For example, according to one embodiment, the midpoint of the distance 27 between the two openings 20, 21 is located a distance 28 from the center 15 of the placemat 10. Further, the center 15 of the placemat 10 is disposed on the linear axis 40. In addition, the openings 20, 21 may be bisected by the linear axis 40. According to another embodiment, the openings may be offset from the linear axis 40 by a distance of approximately one-quarter to two inches (¼-2") either above 41 or below 42 the linear axis 40. In one embodiment, the distance 28 may be approximately six inches (6"). In another embodiment, the distance may be approximately between four and eight inches (4-8").

Napkin Ring

In various embodiments, the placemat assembly 5 includes a napkin ring 30 which includes a fastener 31. In one embodiment, the napkin ring 30 may be a substantially rectangular strip of fabric, which includes a fastener 31. According to one embodiment, the napkin ring 30 may have a length of approximately eight inches (8") and a height of approximately one and a half inches (1.5"). In another embodiment, the napkin ring may include any length that is substantially longer than the distance 27 between the two openings, for example, more than twice the distance 27. According to another embodiment, the napkin ring 30 may have any height that is less than the length of the openings 20, 21. As illustrated in FIG. 10, the napkin ring 30 may have any length that provides for securing the napkin 50 to the placemat 10. In various other embodiments, the size of the ring 30 may be any size as commonly known or understood in the art as being sufficient to permit at least a portion of the napkin 50 to be received therethrough.

According to one embodiment, the fastener may include a button 32 and a buttonhole 33. In another embodiment, the fastener may include a hook and loop fastener. In another embodiment, the fastener may include a snap. Further still, in another embodiment, the fastener may include any fastening device or means known in the art as being sufficient to secure a proximal portion of the napkin ring to a distal portion of the napkin ring. Further, the napkin ring may be rotated through the openings such that the fastener may either be located on top and visible or on the bottom in a hidden manner. In addition, according to another embodiment, the fastener may be configured to secure a portion of the napkin ring to another portion of the napkin ring, and may be further configured for aesthetic appearances, such as matching colors to either the color of the placemat 10 or to colors included in a decorative peripheral border of the placemat 12.

In various embodiments, the napkin ring 30 may also include a strip of fabric which comprises a decorative pattern. The decorative pattern, according to one embodiment, may be substantially similar to a decorative pattern located on a peripheral border 12 of the placemat 10. As such, the decorative pattern of the napkin ring 30 and the peripheral border 12 of the placemat 10 are matched to provide an aesthetically pleasing placemat assembly.

In various embodiments, to make the placemat assembly 5, a manufacturer or similarly situated individual forms at least two openings 20, 21 in a placemat 10. In certain embodiments, the openings 20, 21 are formed by sewing the peripheral edges of the slits of openings 20, 21, such as by stitching the peripheral edges of the slits of the openings with a repeating pattern. In another embodiment of the present invention, a manufacturer may form the openings by placing voids in the placemat when weaving, latticing, or producing the placemat by other construction methods known in the art. According to one embodiment, a manufacturer may coat the peripheral edges of the slits of the openings 20, 21 with a material to reinforce the peripheral edges. In another embodiment, a manufacturer may include a decorative pattern to the peripheral edges of the openings 20, 21. In addition, a manufacturer or similarly situation individual may provide a napkin ring 30 which includes a fastener 31. In another embodiment, the manufacturer may include a fastener, such as a button and buttonhole or a fabric hook and loop fastener.

In various embodiments, to use the placemat assembly 5, a user places an unfastened end of a napkin ring 30 through the first opening 20, when the placemat is positioned towards the user, and through the second opening 21. As such, the ends of the unfastened napkin ring 30 will be situated above the placemat, while a middle portion of the napkin ring 30 will be situated behind the placemat 10. According to another embodiment, a user may place an unfastened end of a napkin ring 30 through the first opening 20, when the placemat is positioned towards the user, and through the second opening 21 such that when the fastener is engaged, the fastener may be positioned behind the placemat and out of view from the user. Alternatively, the napkin ring may be inserted from either side of the placemat and rotate as desired for aesthetics. To attach a napkin 50 to the placemat assembly 5, a user may fold the napkin 50 into any suitable shape for attaching the napkin to the placemat 10. In one embodiment, the user may roll the napkin 50 into a substantially cylindrical shape. In another embodiment, the user may fold the napkin 50 such that the napkin ring 30 may be fastened to secure the napkin 50 to the placemat assembly 5, as shown in FIG. 10. According to one embodiment, a user may fold the napkin and position the napkin within the napkin ring after the fastener of the napkin ring has been engaged. In another embodiment, a user may place the napkin on top of a napkin ring before engaging the fastener, wrap the napkin ring around the folded napkin, and engage the fastener of the napkin ring to secure the napkin to the placemat assembly 5.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A placemat assembly comprising:

a placemat having at least two openings disposed therein; and a napkin ring configured to be removably secured to the placemat via the two openings, the napkin ring comprising a proximal end and a distal end;

wherein the napkin ring is configured to move between an engaged state and a disengaged state, and wherein in the disengaged state, the proximal end and the distal end of the napkin ring define free ends that are configured to pass through at least one of the two openings of the placemat, and wherein in the engaged state, the proximal end of the napkin ring is secured to the distal end of the napkin ring.

2. The placemat assembly of claim 1, wherein a periphery of the openings are sewn.

3. The placemat assembly of claim 1, wherein the at least one opening is substantially a slit.

4. The placemat assembly of claim 1, wherein a length of each of the openings is approximately two inches (2").

5. The placemat assembly of claim 1, wherein the at least two openings are located a distance from one another, the distance being approximately two and a half inches (2.5").

6. The placemat assembly of claim 1, wherein the at least two openings are located at a position offset from a center of the placemat.

7. The placemat assembly of claim 1, wherein at least one of the openings is located approximately two and three-quarters inches (2.75") from a perimeter edge of the placemat.

8. The placemat assembly of claim 1, wherein a center of each of the at least two openings are located on a linear axis bisecting the placemat.

9. The placemat assembly of claim 1, wherein the placemat is substantially rectangular and comprises a perimeter having four sides.

10. The placemat assembly of claim 1, wherein the placemat further comprises a decorative border.

11. The placemat assembly of claim 10, wherein the napkin ring further comprises the decorative pattern.

12. The placemat assembly of claim 1, wherein the napkin ring further comprises a fastener.

13. The placemat assembly of claim 12, wherein the fastener comprises:

a button adapted to be received by a button hole in the napkin ring.

14. The placemat assembly of claim 12, wherein the napkin ring has a rectangular perimeter, and wherein the fastener is configured to join the proximal end of the napkin ring to the distal end of the napkin ring.

* * * * *